US007135103B2

(12) United States Patent
Osaka et al.

(10) Patent No.: US 7,135,103 B2
(45) Date of Patent: Nov. 14, 2006

(54) PREPARATION OF SOFT MAGNETIC THIN FILM

(75) Inventors: Tetsuya Osaka, Tokyo (JP); Tokihiko Yokoshima, Tokyo (JP)

(73) Assignee: Waseda University, Tokyo (JP)

( * ) Notice: Subject to any disclaimer, the term of this patent is extended or adjusted under 35 U.S.C. 154(b) by 0 days.

(21) Appl. No.: 10/816,834

(22) Filed: Apr. 5, 2004

(65) Prior Publication Data

US 2005/0082171 A1 Apr. 21, 2005

(30) Foreign Application Priority Data

Oct. 20, 2003 (JP) ..... 2003-358910

(51) Int. Cl.
*C25D 5/18* (2006.01)

(52) U.S. Cl. ..... 205/104; 205/119; 205/224; 205/255

(58) Field of Classification Search ..... 205/89, 205/103, 104, 119, 224, 255
See application file for complete search history.

(56) References Cited

U.S. PATENT DOCUMENTS 4,869,792 A * 9/1989 Geus et al. ..... 205/508
5,372,698 A * 12/1994 Liao ..... 205/90
5,575,897 A * 11/1996 Komura et al. ..... 205/103
5,582,927 A * 12/1996 Andricacos et al. ..... 428/694 T
6,495,019 B1 * 12/2002 Filas et al. ..... 205/119
6,776,891 B1 * 8/2004 Chen et al. ..... 205/89
6,794,063 B1 * 9/2004 Okada et al. ..... 428/692
6,855,240 B1 * 2/2005 Cooper et al. ..... 205/103
6,876,507 B1 * 4/2005 Chen et al. ..... 360/71
2003/0085131 A1 * 5/2003 Li et al. ..... 205/259
2003/0209295 A1 * 11/2003 Cooper et al. ..... 148/311

FOREIGN PATENT DOCUMENTS

JP 06-096949 A 4/1994
JP 11-074122 B1 3/1999
JP 2000-322707 A 11/2000
JP 2003-347120 A 12/2003

OTHER PUBLICATIONS

F. A. Lowenheim, Electroplating, McGraw-Hill Book Co. New York, 1978, pp. 152-155.*
F. A.Lowenheim, Electroplating, McGraw-Hill Book Co., New York, 1978, pp. 12-13.*
FERROMAGNETISM, Bell Telephone Laboratories, Inc., D. Van Nostrand Company, Inc., Richard M. Bozorth, pp. 165 and 194.

(Continued)

*Primary Examiner*—Roy King
*Assistant Examiner*—William T. Leader
(74) *Attorney, Agent, or Firm*—Birch, Stewart, Kolasch & Birch, LLP

(57) ABSTRACT

A soft magnetic thin film of CoFe alloy having a high Br and low Hc is prepared by furnishing a plating tank including cathode and anode compartments which are separated by a diaphragm or salt bridge so as to permit charge transfer, but inhibit penetration of Fe ions, feeding a plating solution containing Co ions and divalent Fe ions to the cathode compartment, feeding an electrolyte solution to the anode compartment, immersing a substrate in the plating solution, immersing an anode in the electrolyte solution, electroplating, and heat treating the plated film at 100–550° C.; or by immersing a substrate and a soluble anode in a plating solution containing Co ions and divalent Fe ions, electroplating, and heat treating the plated film at 100–550° C.

18 Claims, 3 Drawing Sheets

OTHER PUBLICATIONS

IEEE Transactions on Magnetics, vol. 36, No. 5, Sep. 2000, Electrodeposited Co-Fe and Co-Fe-Ni Alloy Films for Magnetic Recording Write Heads, Xiaomin Liu et al., pp. 3479-3481.

IEEE Transactions on Magnetics, vol. MAG-23, No. 5, Sep. 1987, High Moment CoFe Thin Films by Electrodeposition, Simon H. Liao, Advanced Component Technology Magnetic Peripherals, Inc., pp. 2981-2983.

Digests of the 26th Annual Conference on Magnetics, Japan 2002, Preparation of $B_s$=2, 3T Cofe Electrodeposited Thin Films, K. Imai et al., pp. 1-18.

Imai et al., Digests of the 26th Annual Conference on Magnetics, Japan 2002, Preparation of $B_2$=2.3T Cofe Electrodeposited Thin Films (Translation).

* cited by examiner

PREPARATION OF SOFT MAGNETIC THIN FILM

This Non-provisional application claims priority under 35 U.S.C. § 119(a) on patent application No(s). 2003-358910 filed in Japan on Oct. 20, 2003, the entire contents of which are hereby incorporated by reference.

BACKGROUND OF THE INVENTION

1. Technical Field

This invention relates to methods for preparing soft magnetic thin films based on cobalt and iron, and soft magnetic thin films obtained therefrom.

2. Background Art

Soft magnetic thin films are currently on widespread use in electronic applications such as electronic parts including thin-film magnetic heads, thin-film inductors and thin-film transformers. In particular, in order for a thin-film magnetic head to perform high density magnetic recording, it is necessary to shrink recorded bits, which in turn, requires the thin-film magnetic head to produce a high strength magnetic field for writing. Then the soft magnetic thin film used in the thin-film magnetic head must be formed of a magnetically soft material having a high saturation flux density (Bs). With respect to thin-film inductors and thin-film transformers which are required to reduce their size and the thickness of film, a demand for a magnetically soft material having a high saturation flux density exists like the thin-film magnetic heads.

Magnetic thin films having a high saturation flux density are known in the art. For example, Japanese Patent No. 2,821,456 discloses a method for preparing a soft magnetic thin film of CoNiFe having a saturation flux density of 1.7 to 2.1 tesla (T) by electroplating. JP-A 2000-322707 discloses a method for preparing a soft magnetic film of CoFeNi having a saturation flux density of 2 to 2.3 T by electroplating.

Recently, for the purpose of increasing magnetic recording density or the like, there is a growing interest in the use of CoFe-based alloys having a high saturation flux density as compared with NiFe-based alloys and CoNiFe-based alloys used in the art as soft magnetic thin films.

The saturation flux density of CoFe alloys is described in R. M. Bozorth, "Ferromagnetism," D. Van Nostrand Co. Inc., N.Y., 1951. Theoretically, a saturation flux density of higher than about 2.2 T is available when the alloy composition is in the approximate range: 5 at %≦Co≦70 at % and 30 at %≦Fe≦95 at %. The saturation flux density reaches a maximum of about 2.4 T when the alloy consists of about 35 at % of cobalt and about 65 at % of iron. IEEE. Trans. Magn., 1987, vol. 23, p. 2981 describes that an electroplated CoFe alloy film formed of about 90 at % Co and about 10 at % Fe has a saturation flux density of about 1.9 T.

Also, IEEE. Trans. Magn., 2000, vol. 36, p. 3479 describes a CoFe alloy film composed of about 35 at % Co and about 65 at % Fe. Although this film has the composition alleged as exhibiting a highest saturation flux density, the saturation flux density is only about 2.0 T. That is, the saturation flux density is not so high as expected. This is probably because divalent Fe ions in the plating bath are oxidized.

It is then desirable to form a CoFe alloy film while controlling the oxidation of divalent Fe ions. For example, JP-A 6-96949 discloses a method for preparing a CoFe alloy film by electroplating in a plating solution while adding a reducing agent such as ascorbic acid, hypophosphorous acid, dimethylaminoboran, thiourea, or salts or derivatives thereof to the plating solution for preventing divalent Fe ions from being oxidized or for reducing trivalent Fe ions (formed as a result of oxidation) to a divalent state. The CoFe alloy film obtained by this method, however, has a less satisfactory saturation flux density.

The inventors proposed in Japanese Patent Application No. 2002-153252 to form a CoFe alloy film while adding a boron-based reducing agent to a plating solution for preventing divalent Fe ions from being oxidized. With this method, however, non-metallic components such as boron originating from the reducing agent are incorporated in the CoFe alloy film in addition to Co and Fe, detracting from its saturation flux density. A CoFe alloy film having an inherent saturation flux density is not available as well.

SUMMARY OF THE INVENTION

An object of the invention is to provide a method for effectively preparing a soft magnetic thin film of a cobalt and iron-based alloy without a substantial drop of saturation flux density from its theoretical value.

The inventors have found that a desired soft magnetic thin film of a cobalt and iron-based alloy is prepared by furnishing a plating tank including a cathode compartment and an anode compartment which are separated by a diaphragm or salt bridge so as to permit electric charge transfer, but inhibit penetration of iron ions, the cathode compartment receiving a plating solution containing cobalt ions and divalent iron ions, and the anode compartment receiving an electrolyte solution, immersing a workpiece in the plating solution, immersing an anode in the electrolyte solution, and effecting electroplating to form a film on the workpiece. Since the anode is separated from the plating solution, few or no divalent iron ions are oxidized by the anode. Consequently, few or no hydroxide or other contaminants of trivalent iron ions are taken into the soft magnetic thin film. Any drop of saturation flux density is thus restrained. By heat treating the film at a temperature of 100 to 550° C., it becomes a soft magnetic thin film having a high saturation flux density never found in the prior art.

It has also been found that a desired soft magnetic thin film of a cobalt and iron-based alloy is prepared by immersing a workpiece and a soluble anode in a plating solution containing cobalt ions and divalent iron ions, and effecting electroplating to form a film on the workpiece. Since the anode is dissolved, few or no divalent iron ions are oxidized. Consequently, few or no hydroxide or other contaminants of trivalent iron ions are taken into the soft magnetic thin film. Any drop of saturation flux density is thus restrained. By heat treating the film at a temperature of 100 to 550° C., it becomes a soft magnetic thin film having a high saturation flux density never found in the prior art.

In one aspect, the present invention provides a method for preparing a soft magnetic thin film of a cobalt and iron-based alloy, comprising the steps of furnishing a plating tank including a cathode compartment and an anode compartment which are separated by a diaphragm or salt bridge so as to permit charge transfer, but inhibit penetration of iron ions, the cathode compartment receiving a plating solution containing cobalt ions and divalent iron ions, and the anode compartment receiving an electrolyte solution; immersing a workpiece in the plating solution; immersing an anode in the electrolyte solution; effecting electroplating to form a film on the workpiece; and heat treating the film at a temperature of 100 to 550° C.

In another aspect, the present invention provides a method for preparing a soft magnetic thin film of a cobalt and iron-based alloy, comprising the steps of immersing a workpiece and a soluble anode in a plating solution containing cobalt ions and divalent iron ions; effecting electroplating to form a film on the workpiece; and heat treating the film at a temperature of 100 to 550° C.

In both the embodiments, the electroplating is preferably effected by conducting pulse current. The soft magnetic thin film typically contains 5 to 70 at % of cobalt and 30 to 95 at % of iron and has a saturation flux density (Bs) of at least 2.0 T.

Also contemplated herein are soft magnetic thin films prepared by the above methods.

According to the invention, a soft magnetic thin film of a cobalt and iron-based alloy can be prepared without a substantial drop of saturation flux density from its theory. That is, a soft magnetic thin film having a high saturation flux density can be prepared in an efficient manner. Heat treatment of the film following deposition converts the film into a desired soft magnetic thin film having a high saturation flux density and even a low coercivity at the same time.

DESCRIPTION OF THE PREFERRED EMBODIMENTS

The method for producing a soft magnetic thin film according to the first embodiment of invention is described.

In the first embodiment, a soft magnetic thin film of a cobalt and iron-based alloy is prepared by using a plating tank including a cathode compartment and an anode compartment which are separated by a diaphragm or salt bridge so as to permit electric charge transfer, but inhibit penetration of iron ions, feeding a plating solution containing cobalt ions and divalent iron ions to the cathode compartment, and feeding an electrolyte solution to the anode compartment, immersing a workpiece in the plating solution, and immersing an anode in the electrolyte solution. Electroplating is effected to form a film on the workpiece. The film is heat treated at a temperature of 100 to 550° C.

Figure 1:
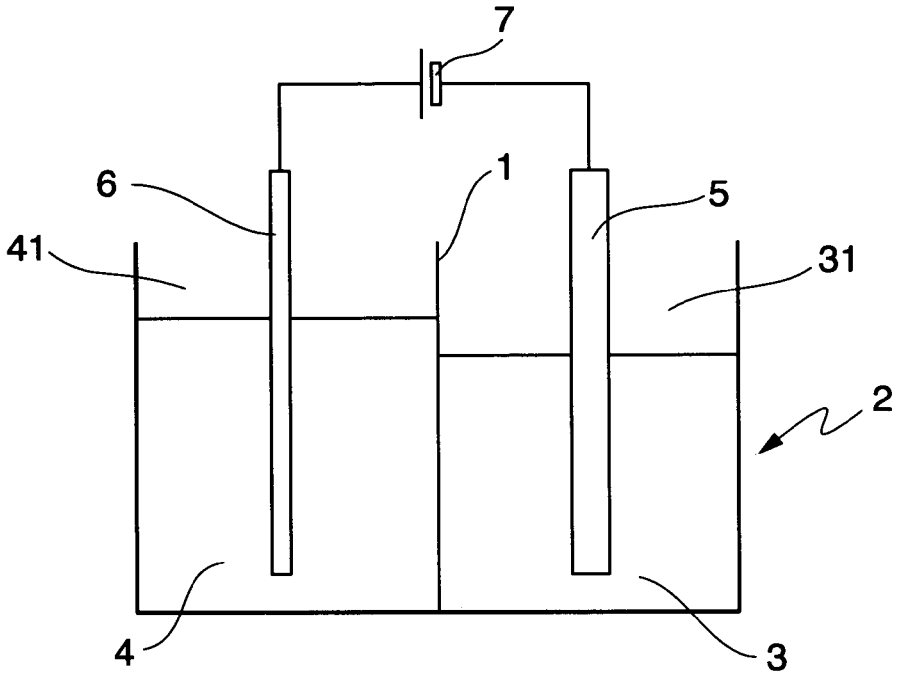
FIGS. 1 to 4 schematically illustrate different exemplary plating systems for producing a soft magnetic thin film in the first embodiment of the inventive method.

In the first embodiment, the way of producing a film by electroplating is implemented, for example, by placing a diaphragm so as to establish a partition between a plating bath and an electrolyte solution, prior to electroplating. Referring to FIG. 1, there is illustrated one exemplary plating system for producing a soft magnetic thin film in the first embodiment. A plating tank 2 is partitioned by a diaphragm 1 into two compartments, cathode and anode compartments 31 and 41. A plating solution 3 is received in the cathode compartment 31, and an electrolyte solution 4 received in the anode compartment 41. A workpiece 5 is immersed in the plating solution 3, and an anode 6 immersed in the electrolyte solution 4. A current flow from a power supply 7 is conducted across the workpiece 5 and the anode 6 to effect electroplating to form a soft magnetic thin film on the workpiece 5.

Electroplating is effected while the anode is immersed in the electrolyte solution rather than the plating solution. The arrangement wherein the anode is not in direct contact with the plating solution prevents divalent Fe ions in the plating solution from being oxidized by the anode. Then no hydroxide or other compounds of trivalent Fe ions resulting from oxidation of divalent Fe ions are taken into the soft magnetic thin film being deposited. A soft magnetic thin film having a saturation magnetic flux density very close to the theory can be produced.

Figure 2:
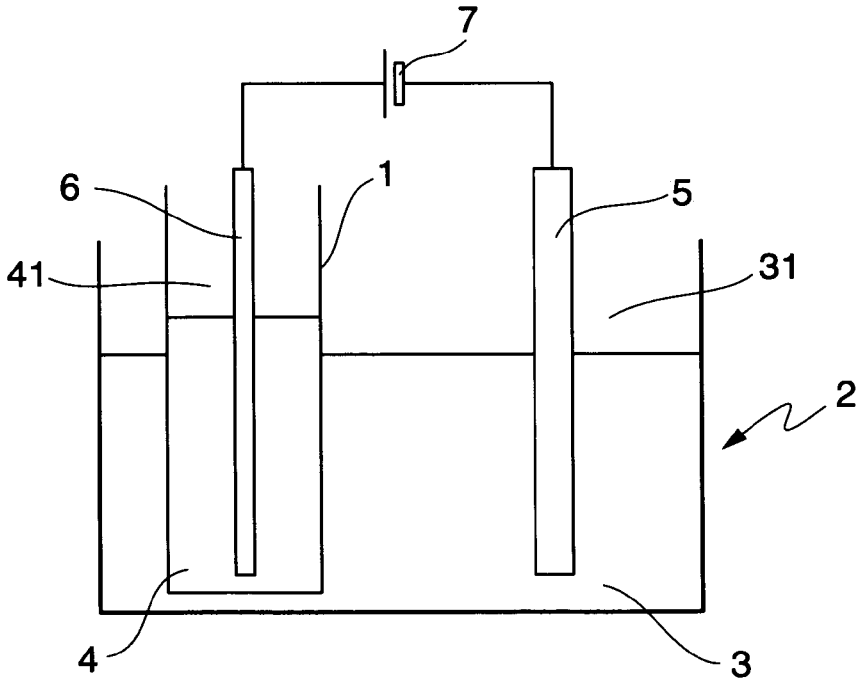

In the first embodiment, the way of producing a film by electroplating is not limited to that shown in FIG. 1. In another example, as shown in FIG. 2, an electrolyte solution 4 is received in a container-shaped diaphragm 1 that constitutes an anode compartment 41. The diaphragm 1 is immersed in a plating solution 3 which is received in a cathode compartment 31. A workpiece 5 is immersed in the plating solution 3, and an anode 6 immersed in the electrolyte solution 4. A current flow from a power supply 7 is conducted across the workpiece 5 and the anode 6 to effect electroplating to form a soft magnetic thin film on the workpiece 5.

Figure 3:
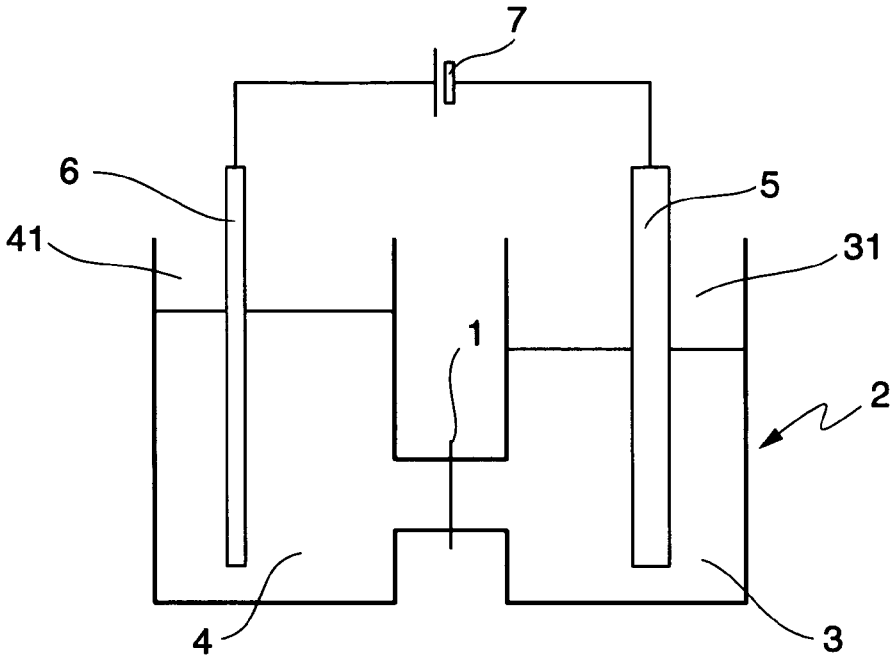

In a further example, as shown in FIG. 3, a cathode compartment 31 and an anode compartment 41 are connected via a diaphragm 1. A plating solution 3 is received in the cathode compartment 31, and an electrolyte solution 4 received in the anode compartment 41. A workpiece 5 is immersed in the plating solution 3, and an anode 6 immersed in the electrolyte solution 4. A current flow from a power supply 7 is conducted across the workpiece 5 and the anode 6 to effect electroplating to form a soft magnetic thin film on the workpiece 5.

In these examples wherein the plating solution and the electrolyte solution are isolated by a diaphragm, the diaphragm is preferably of materials such as porous plastics, porous glass, porous ceramics or semipermeable membrane that permit electric charge transfer between the plating solution and the electrolyte solution, but inhibit penetration of Fe ions therethrough. Of these, use of semipermeable membranes is desirable, for example, dialysis membranes made of polytetrafluoroethylene compounds or sulfonated polyperfluoroethylene compounds.

Figure 4:
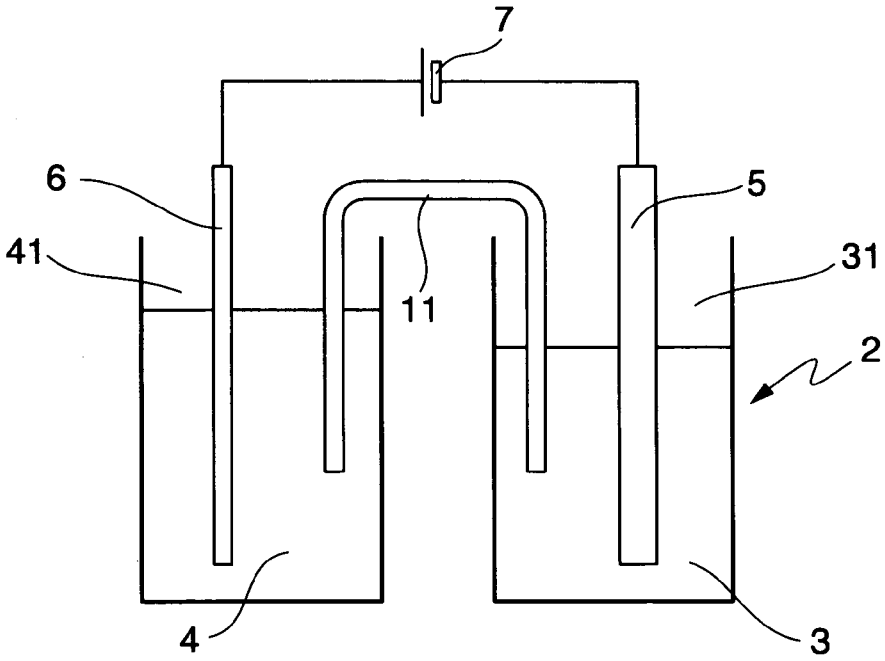

In the first embodiment, yet another way of producing a film by electroplating is shown in FIG. 4. Plating and electrolyte solutions 3 and 4 are contained in cathode and anode compartments 31 and 41, respectively. A workpiece 5 is immersed in the plating solution 3, and an anode 6 immersed in the electrolyte solution 4. A salt bridge 11 is bridged between the cathode and anode compartments 31 and 41 so that its end portions are in contact with the solutions 3 and 4, respectively. A current flow from a power supply 7 is conducted across the workpiece 5 and the anode 6 to effect electroplating to form a soft magnetic thin film on the workpiece 5.

In this example wherein cathode and anode compartments are independent from each other, and a salt bridge is provided so as to permit charge transfer between the plating and electrolyte solutions, the salt bridge used herein is preferably a saturated potassium chloride solution gelled with agar or the like.

In the first embodiment, the electrolyte solution in which the anode is immersed is not particularly limited as long as it is electroconductive. Preferred electrolyte solutions are those containing an anion which is identical with the anion in the plating solution and a cation in the form of a hydrogen ion or alkali metal ion, for example, aqueous solutions containing electrolytes capable of electric conduction such as sulfuric acid and sodium chloride. It is acceptable to use an aqueous solution similar to the plating solution. However, since no plating takes place in the electrolyte solution, the inclusion of metal ions to be deposited is unnecessary, and only the inclusion of electrolytes capable of electric conduction suffices. Also the anodes used in the first embodiment include insoluble anodes, such as platinum, palladium-platinum, platinum-plated titanium, and carbon. Cobalt is useful as well and may be used in the form of either soluble or insoluble anodes.

Described below is the method for producing a soft magnetic thin film according to the second embodiment of invention.

In the second embodiment, a soft magnetic thin film of a cobalt and iron-based alloy is prepared by immersing a workpiece and a soluble anode in a plating solution containing cobalt ions and divalent iron ions, effecting electroplating to form a film on the workpiece, and heat treating the film at a temperature of 100 to 550° C.

Figure 5:
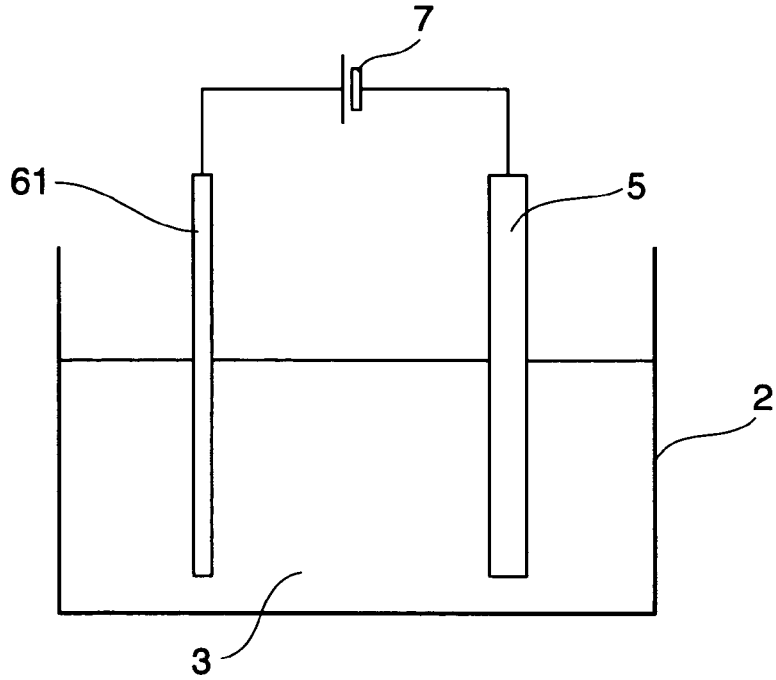
FIG. 5 schematically illustrates an exemplary plating system for producing a soft magnetic thin film in the second embodiment of the inventive method.

In the second embodiment, the way of producing a film by electroplating is implemented, for example, by furnishing a plating tank 2 containing a plating solution 3 as shown in FIG. 5. Both a workpiece 5 and a soluble anode 61 are immersed in the plating solution 3. A current flow from a power supply 7 is conducted across the workpiece 5 and the anode 6 to effect electroplating to form a soft magnetic thin film on the workpiece 5.

In the embodiment using a soluble anode, the anode is dissolved during the plating process, which prevents divalent Fe ions from being oxidized by the anode although the anode is in contact with the plating solution. Then no hydroxide or other compounds of trivalent Fe ions resulting from oxidation of divalent Fe ions are taken into the soft magnetic thin film being deposited. A soft magnetic thin film having a saturation magnetic flux density very close to the theory can be produced.

The soluble anode used in the second embodiment is preferably made of cobalt, iron or an alloy thereof.

In both the first and second embodiments, the plating solution used should contain cobalt ions and divalent iron ions. Sources used for supplying these metal ions are preferably water-soluble cobalt salts and water-soluble iron(II) salts, for example, water-soluble salts including sulfates, chlorides, sulfamates, acetates, and nitrates of Co or Fe (divalent). The concentrations of metal ions in the plating solution may be selected so that desired magnetic properties are achievable. Though not critical, the concentration of each metal salt is preferably in a range of 0.01 to 1.5 mol/dm$^3$, more preferably 0.01 to 0.3 mol/dm$^3$, even more preferably 0.01 to 0.1 mol/dm$^3$. The total concentration of metal ions is preferably in a range of 0.02 to 3.0 mol/dm$^3$, more preferably 0.02 to 0.6 mol/dm$^3$, even more preferably 0.02 to 0.2 mol/dm$^3$.

To the plating solution, conductive salts such as ammonium chloride, buffers such as boric acid, and surfactants such as sodium-dodecylsulfate and sodium dodecylbenzenesulfonate may be added in customary amounts.

On the other hand, the addition of sulfur-containing compounds such as saccharin serving as a stress reducer or brightener should desirably be avoided. If sulfur-containing compounds serving as a stress reducer or brightener are used, sulfur would co-precipitate in the film, detracting from corrosion resistance.

Understandably, the plating solution, when exposed to air, has a possibility to be slightly oxidized with oxygen that is taken in the solution and dissolved therein. To control such oxidation, a reducing agent may be added to the plating solution as long as it has no negative impact on the saturation flux density and other magnetic properties of a soft magnetic thin film. Suitable reducing agents include ascorbic acid, hypophosphorous acid, dimethylaminoboran, thiourea, and salts and derivatives thereof. The amount of reducing agent added may be determined for a particular type thereof and is preferably equal to or less than 0.01 mol/dm$^3$.

The plating solution is preferably acidic to weakly acidic and has pH 1 to 6, especially pH 1.8 to 4. The plating bath is preferably at a temperature of 5 to 30° C.

The workpieces to be plated by the method of the invention include well-known substrates, on which soft magnetic thin films are to be deposited, as used in applications such as electronic parts including thin-film magnetic heads, thin-film inductors, and thin-film transformers. Substrates may be used as supplied if they are metals. If substrates are of non-conductive materials such as glass substrates, a conductive coating is previously formed on their surface (to be plated) by sputtering, electroless plating or the like, prior to use.

In the methods of the invention, electroplating is preferably effected at a cathode current density in the range of 3 to 30 mA/cm$^2$ while the plating solution is quantitatively agitated by means of a rotating disk electrode (RDE) or puddle. Plating while the workpiece is being rotated or swung is also possible. However, air-bubbling agitation should preferably be avoided because it can induce oxidation of the plating solution. The soft magnetic thin film deposited by electroplating preferably has a thickness of 0.01 to 10 μm, more preferably 0.1 to 1 μm.

In the methods of the invention, electroplating may be effected using pulse current. Pulse current helps deposit a highly crystalline thin film. The use of pulse current permits a relatively high current density, with a pulse current density of 30 to 300 mA/cm$^2$, especially 50 to 200 mA/cm$^2$ being acceptable. Since the influences of a pulse current density, pulse duration, and duty ratio on thin film properties are not independent, but correlated with each other, the pulse duration and duty ratio must be determined as appropriate in accordance with the pulse current density. For example, a pulse duration of 0.001 to 0.1 second and a duty ratio of 0.01 to 0.5 are desirable.

By the methods of the invention, a soft magnetic thin film composed of a cobalt and iron-based alloy can be efficiently prepared without a substantial loss of saturation flux density from the theoretical value of the alloy. The methods are advantageous when the plating solution contains large amounts of divalent Fe ions. The methods are advantageous when it is desired to form soft magnetic thin films having cobalt and iron contents in the range: 5 at %≦Co≦70 at % and 30 at %≦Fe≦95 at %. In this range, soft magnetic thin films having a saturation flux density of at least 2.0 tesla (T), more preferably at least 2.1 T, even more preferably at least 2.2 T can be prepared. The methods are more advantageous when it is desired to form soft magnetic thin films having cobalt and iron contents in the range: 30 at %≦Co≦50 at % and 50 at %≦Fe≦70 at %. In this range, soft magnetic thin films having a saturation flux density of at least 2.3 T, more preferably at least 2.35 T, even more preferably about 2.4 T can be prepared.

The soft magnetic thin films prepared by the inventive methods are made of alloys primarily comprising cobalt and iron, preferably alloys consisting essentially of cobalt and iron (substantially free of other elements). However, the invention is not limited thereto, and the inclusion of other metal elements is acceptable. For example, nickel may be added for reduced coercivity, and non-magnetic metal elements such as W, Mo and Cr may be incorporated as co-precipitate for the purposes of improving the corrosion resistance or altering the hardness of soft magnetic thin films. In these examples, ions containing desired metal elements or oxo-acids or oxo-acid salts containing desired metal elements may be added to the plating solution prior to the electroplating.

To impart uniaxial anisotropy to a plated film to control its anisotropic magnetic field, a prior art well-known technique, for example, plating in a unidirectional magnetic field or plating in a perpendicular magnetic field may be employed.

In the methods of the invention, the soft magnetic thin film obtained by the aforementioned electroplating method is heat treated for stabilizing its magnetic properties. Specifically, a soft magnetic thin film of cobalt and iron-based alloy is heat treated at a temperature of 100 to 550° C., preferably 250 to 500° C. Heat treatment reduces coercivity. Since the plated film prepared using pulse current is highly crystalline, heat treatment of such a plated film achieves a substantial drop of coercivity as compared with a plated film prepared without using pulse current. The heat treating time is usually about 15 minutes to about 2 hours, preferably about 30 minutes to about 1 hour. The atmosphere for heat treatment may be air, an inert gas such as nitrogen or argon, or vacuum, with the vacuum being preferred. It is also possible to carry out heat treatment in a subsequent step of fabricating the plated workpiece into a device. Heat treatment in a magnetic field is desirable, and the applied magnetic field is preferably 20 to 500 Oe. Heat treatment in a magnetic field can impart uniaxial anisotropy to the plated film for controlling the magnitude of anisotropic magnetic field.

EXAMPLE

Examples of the invention are given below by way of illustration, but not by way of limitation.

In Examples (EX), Comparative Examples (CE) and Reference Examples (RE) below, the substrates on which soft magnetic thin films were to be deposited were copper foils of 8 μm thick, and glass plates of 0.3 mm thick having Ti and NiFe alloy layers deposited thereon by sputtering.

Reference Example 1

Using a plating system as shown in FIG. 4, a soft magnetic thin film (1 μm) of CoFe alloy was deposited on a substrate by electroplating using a plating solution under plating conditions as shown below. There were used an anode of platinum, a salt bridge of an aqueous saturated potassium chloride solution gelled with agar, and an electrolyte solution in the form of an aqueous 10 vol % sulfuric acid.

| Plating solution | |
|---|---|
| Cobalt sulfate | 0.055–0.06 mol/dm$^3$ |
| Iron(II) sulfate | 0.04–0.045 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| **Plating conditions** | |
| Plating solution temperature | 18° C. |
| Cathode current density | 20 mA/cm$^2$ |
| RDE agitation | 1,000 rpm |

The magnetic property (saturation flux density Bs) of the soft magnetic thin film thus obtained was measured by a vibrating sample magnetometer (VSM), and the composition thereof was analyzed by x-ray fluorescence (XRF) and inductively coupled plasma (ICP) emission spectrometry. The results are shown in Table 1.

Reference Example 2

A soft magnetic thin film (1 μm) was deposited as in Reference Example 1 except that the plating solution of Reference Example 1 was modified to contain 0.05–0.055 mol/dm$^3$ of cobalt sulfate and 0.045–0.05 mol/dm$^3$ of iron (II) sulfate. The magnetic property and composition of the soft magnetic thin film thus obtained were examined, with the results shown in Table 1.

Reference Example 3

A soft magnetic thin film (1 μm) was deposited as in Reference Example 1 except that the plating solution of Reference Example 1 was modified to contain 0.045–0.05 mol/dm$^3$ of cobalt sulfate and 0.05–0.055 mol/dm$^3$ of iron(II) sulfate. The magnetic property and composition of the soft magnetic thin film thus obtained were examined, with the results shown in Table 1.

Reference Example 4

A soft magnetic thin film (1 μm) was deposited as in Reference Example 1 except that the plating solution of Reference Example 1 was modified to contain 0.035–0.04 mol/dm$^3$ of cobalt sulfate and 0.06–0.065 mol/dm$^3$ of iron(II) sulfate. The magnetic property and composition of the soft magnetic thin film thus obtained were examined, with the results shown in Table 1.

Reference Example 5

A soft magnetic thin film (1 μm) was deposited as in Reference Example 1 except that the plating solution of Reference Example 1 was modified to contain 0.09–0.095 mol/dm$^3$ of cobalt sulfate and 0.005–0.01 mol/dm$^3$ of iron(II) sulfate. The magnetic property and composition of the soft magnetic thin film thus obtained were examined, with the results shown in Table 1.

Reference Example 6

Using a plating system as shown in FIG. 2, a soft magnetic thin film (1 μm) of CoFe alloy was deposited on a substrate by electroplating using a plating solution under plating conditions as shown below. There were used an anode of ruthenium-platinum alloy, a diaphragm of Nafion® (semipermeable membrane by DuPont), and an electrolyte solution in the form of an aqueous 10 vol % sulfuric acid.

| Plating solution | |
|---|---|
| Cobalt sulfate | 0.05–0.055 mol/dm$^3$ |
| Iron(II) sulfate | 0.045–0.05 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |

-continued

| Plating conditions | |
|---|---|
| Plating solution temperature | 18° C. |
| Cathode current density | 20 mA/cm$^2$ |
| Puddle agitation | 100 rpm |

The magnetic property (Bs) of the soft magnetic thin film thus obtained was measured by a VSM, and the composition thereof was analyzed by XRF and ICP spectrometry. The results are also shown in Table 1.

Reference Example 7

Using a plating system as shown in FIG. 3, a soft magnetic thin film (1 μm) of CoFe alloy was deposited on a substrate by electroplating using a plating solution under plating conditions as shown below. There were used an anode of platinum, a diaphragm of porous glass, and an electrolyte solution in the form of an aqueous 10 vol % sulfuric acid.

| Plating solution | |
|---|---|
| Cobalt sulfate | 0.05–0.055 mol/dm$^3$ |
| Iron(II) sulfate | 0.045–0.05 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| Plating conditions | |
| Plating solution temperature | 18° C. |
| Cathode current density | 20 mA/cm$^2$ |
| RDE agitation | 1,000 rpm |

The magnetic property (Bs) of the soft magnetic thin film thus obtained was measured by a VSM, and the composition thereof was analyzed by XRF and ICP spectrometry. The results are also shown in Table 1.

Reference Example 8

Using a plating system as shown in FIG. 5, a soft magnetic thin film (1 μm) of CoFe alloy was deposited on a substrate by electroplating using a plating solution under plating conditions as shown below. A soluble anode of cobalt was used.

| Plating solution | |
|---|---|
| Cobalt sulfate | 0.045–0.05 mol/dm$^3$ |
| Iron(II) sulfate | 0.05–0.055 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| Plating conditions | |
| Plating solution temperature | 18° C. |
| Cathode current density | 20 mA/cm$^2$ |
| RDE agitation | 1,000 rpm |

The magnetic property (Bs) of the soft magnetic thin film thus obtained was measured by a VSM, and the composition thereof was analyzed by XRF and ICP spectrometry. The results are also shown in Table 1.

Comparative Example 1

Figure 6:
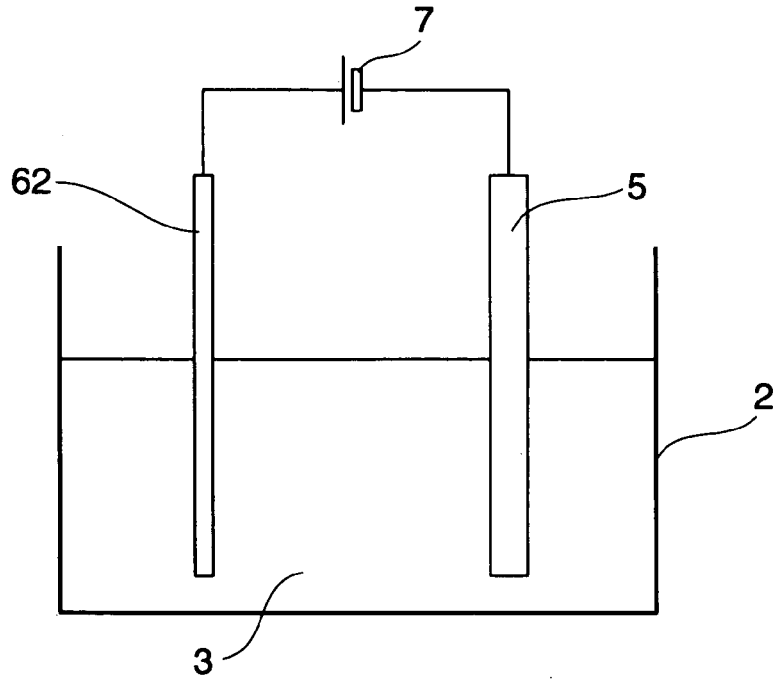
FIG. 6 schematically illustrates a prior art plating system used in Comparative Examples 1 and 2.

A plating system, which does not include a diaphragm, salt bridge and electrolyte solution, is constructed as shown in FIG. 6 such that both a workpiece (substrate) 5 and an insoluble anode 62 are immersed in a plating solution 3. With this system, a soft magnetic thin film (1 μm) of CoFe alloy was deposited on the substrate by electroplating in a plating solution under plating conditions as shown below. The insoluble anode was of platinum. In FIG. 6, 2 is a plating tank and 7 is a power supply.

| Plating solution | |
|---|---|
| Cobalt sulfate | 0.045–0.05 mol/dm$^3$ |
| Iron(II) sulfate | 0.05–0.055 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| Plating conditions | |
| Plating solution temperature | 18° C. |
| Cathode current density | 20 mA/cm$^2$ |
| RDE agitation | 1,000 rpm |

The magnetic property (Bs) of the soft magnetic thin film thus obtained was measured by a VSM, and the composition thereof was analyzed by XRF and ICP spectrometry. The results are also shown in Table 1.

Comparative Example 2

A plating system, which does not include a diaphragm, salt bridge and electrolyte solution, is constructed as shown in FIG. 6 such that both a workpiece (substrate) 5 and an insoluble anode 62 are immersed in a plating solution 3. With this system, a soft magnetic thin film (1 μm) of CoFe alloy was deposited on the substrate by electroplating in a plating solution under plating conditions as shown below. The insoluble anode was of a ruthenium-platinum alloy.

| Plating solution | |
|---|---|
| Cobalt sulfate | 0.045–0.05 mol/dm$^3$ |
| Iron(II) sulfate | 0.05–0.055 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| Plating conditions | |
| Plating solution temperature | 18° C. |
| Cathode current density | 20 mA/cm$^2$ |
| Puddle agitation | 100 rpm |

The magnetic property (Bs) of the soft magnetic thin film thus obtained was measured by a VSM, and the composition thereof was analyzed by XRF and ICP spectrometry. The results are also shown in Table 1.

TABLE 1

| | | Reference Example | | | | | | | | Comparative Example | |
|---|---|---|---|---|---|---|---|---|---|---|---|
| | | 1 | 2 | 3 | 4 | 5 | 6 | 7 | 8 | 1 | 2 |
| Composition | Co (at %) | 68 | 40 | 32 | 20 | 91 | 40 | 41 | 35 | 41 | 40 |
| | Fe (at %) | 32 | 60 | 68 | 80 | 9 | 60 | 59 | 65 | 59 | 60 |
| Bs | Found (T) | 2.2 | 2.4 | 2.4 | 2.3 | 1.9 | 2.4 | 2.4 | 2.4 | 2.0 | 2.1 |
| | Theory (T) | 2.2 | 2.4 | 2.4 | 2.3 | 1.9 | 2.4 | 2.4 | 2.4 | 2.4 | 2.4 |

Reference Example 9, Examples 1–5

Thin films were deposited by the same procedure as in Reference Example 3 and then heat treated under the conditions described below, yielding soft magnetic thin films (Examples 1 to 5).

Heat Treating Conditions

Applied magnetic field:

500 Oe perpendicular to substrate

Heat treating temperature:

not treated, 250, 300, 350, 400, 450° C.

Heating rate: 10° C./min

Heat treating time: 1 hour

Cooling: unforced cooling

The composition of the films was analyzed by XRF and ICP spectrometry. The films consisted of 33 at % of cobalt and 67 at % of iron. The magnetic properties (saturation flux density Bs and coercivity Hc) of the soft magnetic thin films were measured by a vibrating sample magnetometer (VSM). The results are shown in Table 2.

TABLE 2

| | Reference Example | Example | | | | |
|---|---|---|---|---|---|---|
| | 9 | 1 | 2 | 3 | 4 | 5 |
| Heat treating temperature (° C.) | not treated | 250 | 300 | 350 | 400 | 450 |
| Bs (T) | 2.4 | 2.4 | 2.4 | 2.4 | 2.4 | 2.4 |
| Hc (Oe) | 15 | 14 | 11 | 9 | 8 | 10 |

It is evident that the coercivity of the thin film is reduced by heat treatment while maintaining a high saturation flux density.

Reference Example 10

Using a plating system as shown in FIG. 4, a soft magnetic thin film (1 μm) of CoFe alloy was deposited on a substrate by pulse current electroplating using a plating solution under plating conditions as shown below. There were used an anode of platinum, a salt bridge of an aqueous saturated potassium chloride solution gelled with agar, and an electrolyte solution in the form of an aqueous 10 vol % sulfuric acid.

| Plating solution | |
|---|---|
| Cobalt sulfate | 0.045–0.05 mol/dm$^3$ |
| Iron(II) sulfate | 0.05–0.055 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |

-continued

| Plating conditions | |
|---|---|
| Plating solution temperature | 18° C. |
| RDE agitation | 1,000 rpm |
| Pulse current density | 75 mA/cm$^2$ |
| Pulse duration | 0.01 sec |
| Duty ratio | 0.1 |

The magnetic property (saturation flux density Bs) of the soft magnetic thin film thus obtained was measured by a vibrating sample magnetometer (VSM), and the composition thereof was analyzed by x-ray fluorescence (XRF) and inductively coupled plasma (ICP) emission spectrometry. The results are shown in Tables 3 and 4.

Reference Example 11

Using a plating system as shown in FIG. 5, a soft magnetic thin film (1 μm) of CoFe alloy was deposited on a substrate by pulse current electroplating using a plating solution under plating conditions as shown below. A soluble anode of cobalt was used.

| Plating solution | |
|---|---|
| Cobalt sulfate | 0.045–0.05 mol/dm$^3$ |
| Iron(II) sulfate | 0.05–0.055 mol/dm$^3$ |
| Boric acid | 0.4 mol/dm$^3$ |
| Ammonium chloride | 0.4 mol/dm$^3$ |
| Sodium dodecylsulfate | 0.01 g/dm$^3$ |
| pH 2.3 | |
| **Plating conditions** | |
| Plating solution temperature | 18° C. |
| RDE agitation | 1,000 rpm |
| Pulse current density | 75 mA/cm$^2$ |
| Pulse duration | 0.01 sec |
| Duty ratio | 0.1 |

The magnetic property (Bs) of the soft magnetic thin film thus obtained was measured by a VSM, and the composition thereof was analyzed by XRF and ICP spectrometry. The results are shown in Tables 3 and 4.

Reference Example 12

A soft magnetic thin film (1 μm) was deposited by the same procedure as Reference Example 11 except that the pulse current density was 100 mA/cm$^2$. The magnetic property and composition of the thin film were examined, with the results shown in Tables 3 and 4.

TABLE 3

| | | Reference Example | | |
|---|---|---|---|---|
| | | 10 | 11 | 12 |
| Composition | Co (at %) | 37 | 37 | 35 |
| | Fe (at %) | 63 | 63 | 65 |
| Bs | Found (T) | 2.4 | 2.4 | 2.4 |
| | Theory (T) | 2.4 | 2.4 | 2.4 |

Reference Examples 13–15, Examples 6–8

Thin films were deposited by the same procedure as in Reference Examples 10 to 12 and then heat treated under the conditions described below, yielding soft magnetic thin films (Examples 6 to 8).

Heat Treating Conditions

Applied magnetic field:

500 Oe perpendicular to substrate

Heat treating temperature: 400° C.

Heating rate: 10° C./min

Heat treating time: 1 hour

Cooling: unforced cooling

The composition of the films was analyzed by XRF and ICP spectrometry. The films consisted of 37 at % of cobalt and 63 at % of iron in Example 6, 37 at % of cobalt and 63 at % of iron in Example 7, and 35 at % of cobalt and 65 at % of iron in Example 8. The magnetic properties (saturation flux density Bs and coercivity Hc) of the soft magnetic thin films were measured by a vibrating sample magnetometer (VSM). The results are shown in Table 4.

TABLE 4

| | Reference Example | | | Example | | |
|---|---|---|---|---|---|---|
| | 13 | 14 | 15 | 6 | 7 | 8 |
| Heat treating temperature (° C.) | not treated | not treated | not treated | 400 | 400 | 400 |
| Bs (T) | 2.4 | 2.4 | 2.4 | 2.4 | 2.4 | 2.4 |
| Hc (Oe) | 15 | 14 | 15 | 7 | 7 | 5 |

It is evident that when the thin films obtained by pulse current electroplating are heat treated, their coercivity is noticeably reduced while maintaining a high saturation flux density.

Japanese Patent Application No. 2003-358910 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing an electroplated soft magnetic thin film of a cobalt-iron alloy which consists essentially of 30 to 50 at % of cobalt and 50 to 70 at % of iron and has a saturation flux density of at least 2.3 T, comprising the steps of:

furnishing a plating tank including a cathode compartment and an anode compartment which are separated by a diaphragm or salt bridge so as to permit charge transfer, but inhibit penetration of iron ions, the cathode compartment receiving a plating solution containing cobalt ions and divalent iron ions, and the anode compartment receiving an electrolyte solution, immersing a work piece in the plating solution, immersing an anode in the electrolyte solution, effecting electroplating by conducting pulse current across the anode and the workpiece with a pulse current density of 75 to 300 mA/cm$^2$, a pulse duration of 0.01 to 0.1 second, and a duty ratio of 0.01 to 0.5 to form a film on the work piece, and heat treating the film at a temperature of 100 to 550° C.

2. The method of claim 1 wherein the cobalt-iron alloy consists essentially of 32 to 41 at % of cobalt and 59 to 68 at % of iron.

3. The method of claim 1 wherein the saturation flux density is at least 2.35 T.

4. The method of claim 1 wherein the saturation flux density is about 2.4 T.

5. The method of claim 1 wherein the pulse current density is 100 to 300 mA/cm$^2$.

6. The method of claim 1 wherein the plating solution contains cobalt ions in a concentration of 0.01 to 1.5 mol/dm$^3$.

7. The method of claim 1 wherein the plating solution contains iron ions in a concentration of 0.01 to 1.5 mol/dm$^3$.

8. The method of claim 1 wherein the total concentration of metal ions in the plating solution is in a range of 0.02 to 3.0 mol/dm$^3$.

9. The method of claim 1 wherein the plating solution is free of sulfur compounds.

10. The method of claim 1 wherein the plating solution has a pH of 1 to 6.

11. The method of claim 1 wherein the electroplating is conducted while the plating solution is quantitatively agitated by means of a rotating disk electrode.

12. The method of claim 1 wherein the heat treating is conducted in an magnetic field.

13. The method of claim 1 wherein the heat treating is conducted in an magnetic field of 20 to 500 Oe.

14. A method for preparing an electroplated soft magnetic thin film of a cobalt-iron alloy which consists essentially of 30 to 50 at % of cobalt and 50 to 70 at % of iron and has a saturation flux density of at least 2.3 T, comprising the steps of:

immersing a work piece and a soluble anode in a plating solution containing cobalt ions and divalent iron ions, effecting electroplating by conducting pulse current across the anode and the workpiece with a pulse current density of 75 to 300 mA/cm$^2$, a pulse duration of 0.01 to 0.1 second, and a duty ratio of 0.01 to 0.5 to form a film on the work piece, and heat treating the film at a temperature of 100 to 550° C.

15. The method of claim 14 wherein the cobalt-iron alloy consists essentially of 32 to 41 at % of cobalt and 59 to 68 at % of iron.

16. The method of claim 14 wherein the saturation flux density is at least 2.35 T.

17. The method of claim 14 wherein the saturation flux density is about 2.4 T.

18. The method of claim 14 wherein the pulse current density is 100 to 300 mA/cm$^2$.

* * * * *